US005445923A

United States Patent [19]

Takahashi et al.

[11] Patent Number: 5,445,923

[45] Date of Patent: Aug. 29, 1995

[54] LASER BEAM ABSORBING RESIN COMPOSITION AND LASER BEAM MARKING METHOD

[75] Inventors: Jun Takahashi; Akira Yasuda, both of Soka; Hideo Ochi, Misato, all of Japan

[73] Assignee: Somar Corporation, Japan

[21] Appl. No.: 125,798

[22] Filed: Sep. 24, 1993

[30] Foreign Application Priority Data

Sep. 30, 1992 [JP] Japan ..... 4-285099
Dec. 29, 1992 [JP] Japan ..... 4-361167
Jan. 29, 1993 [JP] Japan ..... 5-034577

[51] Int. Cl.[6] ..... G03C 1/725

[52] U.S. Cl. ..... 430/340; 430/332; 430/338; 430/346; 430/495; 430/945

[58] Field of Search ..... 430/945, 346, 332, 338, 430/340, 495; 252/586

[56] References Cited

U.S. PATENT DOCUMENTS 3,983,564 9/1976 Nakazawa et al. ..... 430/495
4,013,566 3/1977 Taylor et al. ..... 210/502
4,358,552 11/1982 Shinohara et al. ..... 523/443
4,392,141 7/1983 Inoue et al. ..... 346/1.1
4,401,992 8/1983 Vorst et al. ..... 346/762
4,510,512 4/1985 Okamoto et al. ..... 346/209
5,035,983 7/1991 Kiyonari et al. ..... 430/346
5,229,438 7/1993 Ishida et al. ..... 523/428

FOREIGN PATENT DOCUMENTS 58-047016 3/1983 Japan .

OTHER PUBLICATIONS

English language abstract of JP 4-267191, "Laser Marking and Resin Compsoition Therefor", Kiyonari et al., Sep. 1992.

*Primary Examiner*—Charles L. Bowers, Jr.
*Assistant Examiner*—John A. McPherson
*Attorney, Agent, or Firm*—Lorusso & Loud

[57] ABSTRACT

A laser beam absorbing resin composition is disclosed which includes 100 parts by weight of a thermosetting resin, a colorant capable of discoloring upon being heated at a temperature of 250° C. or more, and at least 10 parts by weight of a particulate, laser beam absorbing substance which has an average particle size of 50 μm or less and which is at least one member selected from cordierite and zeolite. By irradiating a shaped, hardened body of the above composition with a laser beam, the colorant is thermally decomposed, so that the color of the irradiated surface is changed and becomes discriminitive from that of non-irradiated surface.

29 Claims, No Drawings

LASER BEAM ABSORBING RESIN COMPOSITION AND LASER BEAM MARKING METHOD

BACKGROUND OF THE INVENTION

This invention relates to a thermosetting resin composition affording a hardened surface on which a clear mark, sign, letter or the like pattern can be marked with a laser beam. The present invention is also directed to a laser beam marking method.

There is a known marking method in which a laser beam is irradiated on a surface of a shaped body containing a laser marking material, so that the irradiated portions are colored or discolored to form a desired, discriminative pattern on the surface of the shaped body. Such a laser marking material is a lead compound, copper oxalate, cobalt oxalate, aluminum acetylacetone, bismuth oxalate, silver acetate or a metal titanate. The laser marking material is mixed in a resin matrix material and the resulting composition is shaped into a desired form.

The known composition, however, has a problem because a clear, high contrast pattern is not obtainable even if the irradiation is sufficiently carried out.

SUMMARY OF THE INVENTION

It is, therefore, the prime object of the present invention to provide a laser beam absorbing resin composition which can give a hardened, shaped body whose surface affords a clear, high contrast pattern by irradiation with a laser beam.

Another object of the present invention is to provide a composition of the above-mentioned type which can give a deep or dark color pattern on a light or white background, a white color pattern on a dark background or any other desired color combinations.

It is a special object of the present invention to provide a composition of the above-mentioned type which can give a desired shaped body without difficulty.

In accomplishing the foregoing objects, there is provided in accordance with the present invention a laser beam absorbing resin composition, comprising 100 parts by weight of a thermosetting resin, a colorant capable of discoloring upon being heated at a temperature of 250° C. or more, and at least 10 parts by weight of a particulate, laser beam absorbing substance which has an average particle size of 50 μm or less and which is at least one member selected from cordierite and crystalline zeolite.

In another aspect, the present invention provides a marking method comprising the steps of forming a shaped body of the above composition, hardening said shaped body to form a hardened body having a first color, and irradiating a surface of said hardened body with a laser beam to discolor said colorant, so that the irradiated surface has a second color discriminative from said first color.

Other objects, features and advantages of the present invention will become apparent from the detailed description of the invention to follow.

DETAILED DESCRIPTION OF THE PREFERRED EMBODIMENTS OF THE INVENTION

Laser beam absorbing, thermosetting resin composition according to the present invention contains a laser beam absorbing substance (hereinafter referred to as LB absorber) which has an average particle size of 50 μm or less, preferably 0.5–15 μm, and which is cordierite and/or crystalline zeolite. The LB absorber is used in an amount of at least 10 parts by weight, preferably 50–300 parts by weight, per 100 parts by weight of the thermosetting resin.

Cordierite is a mineral expressed by the formula: $2MgO.2Al_2O_3.5SiO_2$. Natural cordierite which generally contains water and impurity metals such as Fe substituted for part of Mg may be used for the purpose of the present invention. High purity synthetic cordierite obtained from talc-alumina-kaolin is preferably used.

Both natural and synthetic crystalline zeolite may be suitably used in the present invention. Examples of suitable crystalline zeolite include silicalite, aluminosilicate, aluminogallosilicate, aluminoborosilicate, faujasite and mordenite. Physical properties, such as pore characteristics, of crystalline zeolite are not specifically limited. Generally, crystalline zeolite having a pore diameter of at least 2 Å (angstrom), preferably 2–10 Å, is used.

A colorant capable of being disclored upon being irradiated with a laser beam is incorporated into the laser beam absorbing resin composition. A substance which undergoes a chemical change (generally thermal decomposition and/or oxidation) and discolors when heated at a temperature of 250° C. or more, preferably 300°–1,000° C., is suitably used as such a colorant. The term "discolor" used herein is intended to refer a phenomenon which is caused by irradiation of a laser beam and by which a surface of the laser beam absorbing resin composition irradiated with the laser beam is visually discriminitive from non-irradiated surfaces. Thus, the colorant may be, for example, (a) a substance which has a first color (such as white, black or blue) at room temperature but shows a second color different from the first color upon laser beam irradiation, (b) a substance which has a color (such as white, black or blue) at room temperature but becomes colorless upon laser beam irradiation, and (c) a substance which is white at room temperature and which is converted into another white substance upon laser beam iradiation.

The previously described laser marking materials may be suitably used as the laser beam-discoloring colorants. Examples of other colorants include basic nickel carbonate, basic copper carbonate, bismuth oxide, ferric hydroxide, ammonium vanadate, hydrated alumina, zinc borate, zinc carbonate, carbon black, lead oxide, basic lead phosphite, basic lead sulfite, basic lead phosphite sulfite, lead phosphite and lead sulfite. Various organic dyes and pigments may also be used for the purpose of the present invention. The amount of the laser beam-discoloring colorant varies with the kind of thereof but, generally in the range of 0.1–50 % by weight based on the total weight of the laser beam absorbing resin composition.

If desired, an auxiliary colorant which is inert to laser beam irradiation, such as ferric oxide or titanium oxide, may be incorporated into the laser beam absorbing resin composition to control the color thereof. The color of the composition is a mixed color of the respective ingredients constituting the composition, generally a mixed color of the colorant, filler and auxiliary colorant. The colorant of the above-mentioned type (c) should be used in conjunction with another colorant and/or auxiliary colorant which is not white in order to provide a background color other than white.

Because of high laser beam-absorbing power of the above LB absorber, when a surface of a shaped body formed from the laser beam absorbing resin composition is irradiated with a laser beam, the irradiated portion only is heated to a high temperature to cause not only the thermal decomposition of the resin but also the discoloration of the colorant. The thermal decomposition of the resin generally results in the formation of gasous products so that the resin disappears from the irradiated surfaces. When the laser beam discoloring colorant used is of the above-mentioned type (a) in which discoloration from a first color to second color is caused by laser beam irradition, the color of the irradiated surface generally turns from a first, mixed color of the first color and the other ingredients to a second, mixed color of the second color and the other ingredients. When the discloring colorant is of the type (b) which becomes colorless upon being heated, the color of the laser beam-irradiated surface shows a mixed color of the ingredients other than that colorant. On the other hand, when the laser beam discoloring colorant used is of the type (c) which is converted into another substance but whose color (white) remains unchanged upon laser beam irradiation, the color of the laser beam-irradiated surface is white.

It is preferred that the laser beam absorbing thermosetting resin composition of the present invention contain an inorganic filler having an average particle size of 50 μm or less, preferably 0.5–30 μm, for reasons of improving heat conductivity, mechanical strength, flame resistance or the like physical property. Illustrative of suitable inorganic fillers are alumina, silica, magnesia, antimony trioxide, calcium carbonate, magnesium carbonate, mica, clay and sepiolite. The use of silica such as amorphous (fused) silica or crystalline silica is particularly preferred because of its additional property of improving laser beam absorbing power. The inorganic filler may be a thixotropic agent such as (a) silica or alumina having an average particle size of 0.1 μm or less or (b) aluminum hydroxide, fibrous magnesium oxysulfate, fibrous silica, fibrous potassium titanate, flake mica or montmorillonite-organic base double salt (bentonite) having an average particle size of 3 μm or less. The inorganic filler is used in an amount of 300% by weight or less based on the weight of the thermosetting resin.

The thermosetting resin may be, for example, an epoxy resin, a phenol resin, a bismaleimide resin, an unsaturated polyester resin or an urethane resin. Above all, an epoxy resin is preferably used.

As the epoxy resin to be used in the present invention, there may be mentioned a diglycidyl ether of bisphenol A, a diglycidyl ether of bisphenol F, a cresol novolak epoxy resin, a phenol novolak epoxy resin, an alkylphenol novolak epoxy resin, an alicyclic epoxy resin, a hydrogenated diglycidyl ether of bisphenol A, a hydrogenated diglycidyl ether of bisphenol AD, a diglycidyl ether of a polyol such as propylene glycol or pentaerythrytol, an epoxy resin obtained by reaction of an aliphatic or aromatic carboxylic acid with epichlorohydrin, an epoxy resin obtained by reaction of an aliphatic or aromatic amine with epichlorohydrin, a heterocyclic epoxy resin, a spiro-ring containing epoxy resin and a resin modified with an epoxy group. These epoxy resins may be used singly or as a mixture of two or more thereof. If desired the above epoxy resin may be used in conjunction with a thermoplastic resin.

As a curing agent for the epoxy resin, there may be used, for example, an acid anhydride, an amine, a mercaptane, a polyamide, a boron compound, dicyandiamide or its derivative, a hydrazide, an imidazole compound, a phenol compound or an amineimide.

Above all the use of an acid anhydride is preferred. Examples of the acid anhydrides include phthalic anhydride, trimellitic acid anhydride, pyromellitic acid anhydride, 3,3',4,4'-benzophenonetetracarboxylic anhydride, ethylene glycol bisanhydrotrimellitate, glycerol trisanhydrotri-mellitate, 5-(2,5-dioxotetrahydrofuryl)-3-methyl-3-cyclohexene-1,2-dicarboxylic anhydride, tetrahydrophthalic anhydride and 4,4'-oxydiphthalic anhydride.

The anhydride curing agent is preferably used in conjunction with a phenol resin which is preferably obtained by reaction of a phenol compound with formaldehyde and contains at least two hydroxyl groups. Illustrative of suitable phenol resins are phenol novolak resins, cresol novolak resins, t-butylphenol novolak resins, actylphenol novolak resins, nonylphenol novolak resins and bisphenol novolak resins. These phenol resins may be used singly or as a mixture of two or more thereof. A phenol resin obtained by reaction of two or more different phenol compounds with formaldehyde may also be used for the purpose of the present invention.

The curing agent is generally used in an amount of 0.5–1.5 equivalents, preferably 0.7–1.2 equivalents, per one equivalent of epoxy groups of the epoxy resin.

The curing agent may be used in combination with a curing accelerator, if desired. Examples of curing accelerators include tertiary amines such as triethylamine, N,N-dimethylbenzylamine, 2,4,6-tris(dimethylaminomethyl)phenol and N,N-dimethylaniline; imidzole compounds such as 2-methylimidazole and 2-phenylimidazole; triazine salts, cyanoethyl salts and cyanoethyltrimellitic acid salts of imidazole compounds; metal salts such as zinc acetate and sodium acetate; quarternary ammonium salts such as tetraammonium bromide; amides; peroxides; azo compounds; cyanates; isocyanates; triphenylphosphine; and phenol novolak salt of DBU (1,8-diazabicyclo(5,4,0)undecene-7). The curing accelerator is used in an amount of 0.05–10 parts by weight, preferably 0.1–5 parts by weight per 100 parts by weight of the epoxy resin.

The above epoxy resin composition may additionally contain one or more additives such as a flame retardant such as hexabromobenzene, antimony trioxide or tetrabromobisphenol A; a coupling agent such as of a zirocoaluminum type, a silane type or a titanium type; a leveling agent such as an acrylic acid ester oligomer; a resin such as a butyral resin or a polyester; and a rubber such as carboxy-terminated butadiene acrylonitrile copolymer rubbers and nitrile-butadiene rubbers.

It has been found that a problem of increase in viscosity is caused when an epoxy resin is used as the thermosetting resin of the laser beam absorbing resin composition. Thus, the viscosity a liquid composition gradually increases with time during storage. In the case of a powder composition, the viscosity thereof in the molten state increases when the powder composition is stored for a long period of time. The present inventors have found that water contained in the composition accounts for the viscosity increase. It has been also found that the viscosity increase is significant when the combination of the epoxy hardener and the laser beam-discoloring colorant is in the acid-base relationship, i.e. when an acidic curing agent such as an acid anhydride or a phenol compound is used in combination with a basic colorant such as an alkali salt, a hydroxide or an acid, or when a basic curing agent such as an amine, an imidazole compound, a dicyandiamide compound or an amine amide is used in combination with an acidic colorant such as an oxalate, a formate, a sulfate or a nitrate.

The problem of the viscosity increase has been found to be overcome when zeolite substantially free of water is used as the laser beam absorbing substance. Probably, water contained in the laser beam absorbing resin composition which would accelerate the interaction between the epoxy hardener and the colorant is absorbed by the zeolite so that the viscosity increase is prevented.

Thus, zeolite to be used as the laser beam absorbing substance is desired to have a particle size of 2–10 Å, more preferably 2–5 Å, for reasons of high water-absorbing power. It is also preferred that the zeolite have been dried at, for example, 200° C. or more so that the water content thereof is below 1% by weight, more preferably below 0.5% by weight.

The laser beam absorbing resin composition of this invention is in the form of powder or liquid (dispersion) and is used for forming a shaped body. The term shaped body used herein is intended to refer to a plate, a film, a pipe, a block, a coating or the like molded article or a composite article using these materials. Coatings, casings or packages for electric or electronic parts, such as condensers, resistors, diodes, IC, are typical examples of the shaped bodies.

In the case of a liquid composition, the composition is generally formed into a two-components pack consisting of a first component pack including a thermosetting resin, a colorant, an LB absorber, etc. and a second component pack including a curing agent and a curing accelerator (if used), and, in use, the two components are mixed with each other. Various known methods may be used for the preparation of the shaped bodies, such as transfer molding, injection molding, press molding, casting, dipping, fluidized powder coating, electrostatic spray coating and brush coating.

A desired mark or pattern having a color clearly discriminitive from the background can be marked on the surface of the shaped body formed from the laser beam absorbing resin composition with a laser beam. Suitable laser beam used for marking is that which has a wavelength in an infrared or near infrared radiation region. Carbon dioxide laser beam and YAG (yttrium-aluminum-garnet) laser beam are illustrative of suitable laser beams. Commercially available laser beam generating devices may be suitably used. Such laser beam generating devices generally produces a laser beam with a radiation energy of 2–10 J/cm$^2$. The irradiation of laser beam is performed for a period of time sufficient to discolor the irradiated surface of the shaped body and is preferably less than $10^{-5}$ second.

The following examples will further illustrate the present invention.

EXAMPLE 1

The ingredients shown in Tables 1–5 below were blended in the amounts shown in Tables 1–5 to obtain compositions of Sample Nos. 1–65. In Tables 1–5, the amounts are parts by weight and abbreviations and trademarks are as follows:

EPIKOTE 828: Bisphenol A epoxy resin manufactured by Yuka-Shell Eopoxy Inc.

EPIKOTE 1002: Bisphenol A epoxy resin manufactured by Yuka-Shell Eopoxy Inc.

Anhydride A: Methyltetrahydrophthalic anhydride

Anhydride B: Benzophenone tetracarbolylic anhydride

Phenol Resin: Phenol novolak resin (Tamanol 754, hydroxyl equivalent: 104, manufactured by Arakawa Chemical Industry Inc.)

BDMA: Benzyldimethylamine

TPP: Triphenylphosphine

Silica: Crystallite A-1 (manufactured by Tatsumori Inc., average particle size: 12 μm)

Cordierite: SS-200 (manufactured by Marusu Yuyaku Inc., average particle size: 7 μm)

Cu carbonate: Basic copper carbonate, light blue green colorant

Cu oxalate: Copper (II) oxalate, light blue colorant

Pb phosphite: Basic lead phosphite, white colorant

Bi oxide: Bismuth oxide, yellow colorant

Fe hydroxide: Ferric hydroxide, yellow colorant

Tipaque: R-830 (manufactured by Ishihara Sangyo Inc., titanium oxide white pigment Cyanin Blue: Cyanin Blue PI, phthalocyanin pigment Each of Samples Nos. 1–65 was applied on a surface of an aluminum plate (50 mm×50 mm×1.5 mm) and the coating was heated at 100° C. for 3 hours to form a cured resin layer (thickness: 0.5 mm) thereon. Bar mark (line width: 0.2 mm) was then marked on the coated resin layer by irradiation with a laser beam ($CO_2$ laser, wavelength: 10.6 μm, energy: 4 J/cm$^2$) using a commercially available laser beam marking device (IEA Unimark 400, manufactured by Ushio Electric Co., Ltd.). The color of the mark and the background color were as summarized below:

| Sample No. | Background Color | Color of Mark |
|---|---|---|
| 1–26 | Blue | Black |
| 27–37 | White | Black |
| 38–39 | Blue | Black |
| 40–50 | Yellow | Black |
| 51–52 | Bluish Green | Black |
| 53–63 | Yellow | Red Brown |
| 64–65 | Bluish Green | Red Brown |

The bar mark formed in each Sample was observed to evaluate the visibility thereof in terms of (a) color difference between the mark and the background (i.e. degree of change in color by laser beam irradiation) and (b) uniformity of the mark, on the basis of the following ratings:

(a) Color difference:

0: almost no difference

1: slight difference

2: not clear difference

3: appreciable difference

4: clear difference

5: very clear difference (b) Uniformity:

1: Mark was partly missed

2: Mark was partly blurred

3: Mark was uniform

4: Mark was very uniform and well defined

The results are summarized in Tables 1–5.

EXAMPLE 2

Example 1 was repeated in the same manner as described except that the compositions shown in Tables 6–8 were substituted for those in Example 1 to obtain Sample Nos. 66–104. In Tables 6–8, abbreviations and trademarks are as follows (abbreviations and trademarks similar to those indicated in Example 1 represent the same ingredients):

Hydrated Al: Hydrated alumina, white colorant
Zn borate: Zinc borate, white colorant
Zn carbonate: Zinc carbonate, white colorant
Fe oxide: Red iron oxide, red brown inert colorant Bar mark was formed in each Sample in the same manner as that in Example 1 and was observed to evaluate the visibility thereof in the same manner as that in Example 1. The results are shown in Tables 6–8. The background color of the cured resin layer of Sample Nos. 66–104 was red brown and the color of the mark was white.

EXAMPLE 3

Example 1 was repeated in the same manner as described except that zeolite (average particle size: 10 μm, pore diameter: 4 A) was substituted for cordierite to obtain Sample Nos. 105–169. The results are shown in Tables 9–13. The background colors and the colors of the marks of Samples Nos. 105–169 are the same as those of Samples Nos. 1–65, respectively.

EXAMPLE 4

Example 2 was repeated in the same manner as described except that zeolite (average particle size: 10 μm, pore diameter: 4 A) was substituted for cordierite to obtain Sample Nos. 170–208. The results are shown in Tables 14–16. The background colors and the colors of the marks of Samples Nos. 170–208 are the same as those of Samples Nos. 66–104, respectively.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

TABLE 1

| Sample No. | 1 | 2 | 3 | 4 | 5 | 6 | 7 | 8 | 9 | 10 | 11 | 12 | 13 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Cu carbonate | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 4 | 5 | 4 | 4 |
| Uniformity | 1 | 1 | 3 | 3 | 4 | 4 | 4 | 3 | 3 | 4 | 4 | 4 | 4 |

TABLE 2

| Sample No. | 14 | 15 | 16 | 17 | 18 | 19 | 20 | 21 | 22 | 23 | 24 | 25 | 26 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Cu oxalate | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 4 | 5 | 4 | 4 |
| Uniformity | 1 | 1 | 3 | 3 | 4 | 4 | 4 | 3 | 3 | 4 | 4 | 4 | 4 |

TABLE 3

| Sample No. | 27 | 28 | 29 | 30 | 31 | 32 | 33 | 34 | 35 | 36 | 37 | 38 | 39 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |

TABLE 3-continued

| Sample No. | 27 | 28 | 29 | 30 | 31 | 32 | 33 | 34 | 35 | 36 | 37 | 38 | 39 |
|---|---|---|---|---|---|---|---|---|---|---|---|---|---|
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Pb phosphite | 40 | 20 | 40 | 40 | 40 | 40 | 40 | 40 | 40 | 40 | 40 | 20 | 20 |
| Cyanin Blue | 10 | 40 | 80 | 100 | 2 | 5 | 20 | 50 | 20 | 20 | 1 | 1 | |
| Tipaque | 3 | 1.5 | 3 | 3 | 3 | 3 | 3 | 3 | 3 | 3 | 3 | 3 | 3 |
| Color Difference | 2–1 | 1–0 | 2–3 | 3 | 4 | 5 | 5 | 2–3 | 3 | 4 | 5 | 4 | 4 |
| Uniformity | 1 | 1 | 2 | 3 | 3 | 4 | 2 | 3 | 3 | 4 | 3 | 3 | 4 |

TABLE 4

| Sample No. | 40 | 41 | 42 | 43 | 44 | 45 | 46 | 47 | 48 | 49 | 50 | 51 | 52 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Bi oxide | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 4 | 4 |
| Uniformity | 1 | 1 | 2 | 3 | 4 | 4 | 4 | 2 | 3 | 4 | 4 | 4 | 4 |

TABLE 5

| Sample No. | 53 | 54 | 55 | 56 | 57 | 58 | 59 | 60 | 61 | 62 | 63 | 64 | 65 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Fe hydroxide | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 4 | 4 | 4 | 2 | 3 | 3 | 4 | 3–4 | 3–4 |
| Uniformity | 1 | 1 | 3 | 3 | 4 | 4 | 4 | 3 | 3 | 3 | 4 | 3 | 3 |

TABLE 6

| Sample No. | 66 | 67 | 68 | 69 | 70 | 71 | 72 | 73 | 74 | 75 | 76 | 77 | 78 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |

TABLE 6-continued

| Sample No. | 66 | 67 | 68 | 69 | 70 | 71 | 72 | 73 | 74 | 75 | 76 | 77 | 78 |
|---|---|---|---|---|---|---|---|---|---|---|---|---|---|
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Hydrated Al | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 5 | 5 |

TABLE 7

| Sample No. | 79 | 80 | 82 | 82 | 83 | 84 | 85 | 86 | 87 | 88 | 89 | 90 | 91 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Zn borate | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 5 | 5 |

TABLE 8

| Sample No. | 92 | 93 | 94 | 95 | 96 | 97 | 98 | 99 | 100 | 101 | 102 | 103 | 104 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Cordierite | | | | | | | | | | | | | |
| Colorant | | | | | | | | | | | | | |
| Zn carbonate | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 5 | 5 | 5 | 5 |

TABLE 9

| Sample No. | 105 | 106 | 107 | 108 | 109 | 110 | 111 | 112 | 113 | 114 | 115 | 116 | 117 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |

TABLE 9-continued

| Sample No. | 105 | 106 | 107 | 108 | 109 | 110 | 111 | 112 | 113 | 114 | 115 | 116 | 117 |
|---|---|---|---|---|---|---|---|---|---|---|---|---|---|
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Cu carbonate | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 4 | 5 | 4 | 4 |
| Uniformity | 1 | 1 | 3 | 3 | 4 | 4 | 4 | 3 | 3 | 4 | 4 | 4 | 4 |

TABLE 10

| Sample No. | 118 | 119 | 120 | 121 | 122 | 123 | 124 | 125 | 126 | 127 | 128 | 129 | 130 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDRA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Cu oxalate | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 4 | 5 | 4 | 4 |
| Uniformity | 1 | 1 | 3 | 3 | 4 | 4 | 4 | 3 | 3 | 4 | 4 | 4 | 4 |

TABLE 11

| Sample No. | 131 | 132 | 133 | 134 | 135 | 136 | 137 | 138 | 139 | 140 | 141 | 142 | 143 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Pb phosphite | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2–1 | 1–0 | 2–3 | 3 | 4 | 5 | 5 | 2–3 | 3 | 4 | 5 | 4 | 4 |
| Uniformity | 1 | 1 | 2 | 3 | 3 | 4 | 4 | 2 | 3 | 3 | 4 | 3 | 3 |

TABLE 12

| Sample No. | 144 | 145 | 146 | 147 | 148 | 149 | 150 | 151 | 152 | 153 | 154 | 155 | 156 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |

TABLE 12-continued

| Sample No. | 144 | 145 | 146 | 147 | 148 | 149 | 150 | 151 | 152 | 153 | 154 | 155 | 156 |
|---|---|---|---|---|---|---|---|---|---|---|---|---|---|
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Bi oxide | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 4 | 4 |
| Uniformity | 1 | 1 | 2 | 3 | 4 | 4 | 4 | 2 | 3 | 4 | 4 | 4 | 4 |

TABLE 13

| Sample No. | 157 | 158 | 159 | 160 | 161 | 162 | 163 | 164 | 165 | 166 | 167 | 168 | 169 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Fe hydroxide | 40 | 20 | 40 | 40 | 40 | 40 | 40 | 40 | 40 | 40 | 40 | 20 | 20 |
| Cyanin Blue | | | | | | | | | | | | 1 | 1 |
| Tipaque | 3 | 1.5 | 3 | 3 | 3 | 3 | 3 | 3 | 3 | 3 | 3 | 3 | 3 |
| Color Difference | 2 | 1 | 2 | 3 | 4 | 4 | 4 | 2 | 3 | 3 | 4 | 3–4 | 3–4 |
| Uniformity | 1 | 1 | 3 | 3 | 4 | 4 | 4 | 3 | 3 | 3 | 4 | 3 | 3 |

TABLE 14

| Sample No. | 170 | 171 | 172 | 173 | 174 | 175 | 176 | 177 | 178 | 179 | 180 | 181 | 182 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Hydrated Al | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 5 | 5 |

TABLE 15

| Sample No. | 183 | 184 | 185 | 186 | 187 | 188 | 189 | 190 | 191 | 192 | 193 | 194 | 195 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |

TABLE 15-continued

| Sample No. | 183 | 184 | 185 | 186 | 187 | 188 | 189 | 190 | 191 | 192 | 193 | 194 | 195 |
|---|---|---|---|---|---|---|---|---|---|---|---|---|---|
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Zn borate | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 4 | 5 | 5 | 2 | 3 | 4 | 5 | 5 | 5 |

TABLE 16

| Sample No. | 196 | 197 | 198 | 199 | 200 | 201 | 202 | 203 | 204 | 205 | 206 | 207 | 208 |
|---|---|---|---|---|---|---|---|---|---|---|---|---|---|
| Thermosetting resin | | | | | | | | | | | | | |
| EPIKOTE 828 | 100 | 100 | 100 | 100 | 100 | 100 | 100 | 100 | 100 | 100 | 100 | | |
| EPIKOTE 1002 | | | | | | | | | | | | 100 | 100 |
| Curing Agent | | | | | | | | | | | | | |
| Anhydride A | 87 | 87 | 87 | 87 | 87 | 87 | 87 | 87 | 87 | 87 | 87 | | |
| Anhydride B | | | | | | | | | | | | 20 | |
| Phenol Resin | | | | | | | | | | | | | 15 |
| Accelerating agent | | | | | | | | | | | | | |
| BDMA | 1.5 | 1.5 | 1.5 | 1.5 | 1.5 | 1.5 | 1.5 | 1.5 | 1.5 | 1.5 | 1.5 | | |
| TPP | | | | | | | | | | | | 1.0 | 1.8 |
| Filler | | | 100 | | | | | 98 | 95 | 80 | 50 | 100 | 100 |
| Silica | | | | | | | | | | | | | |
| LB absorber | | | | 10 | 40 | 80 | 100 | 2 | 5 | 20 | 50 | 20 | 20 |
| Zeolite | | | | | | | | | | | | | |
| Colorant | | | | | | | | | | | | | |
| Zn carbonate | 40 | 20 | 40 | 40 | 40 | 40 | 40 | 40 | 40 | 40 | 40 | 20 | 20 |
| Tipaque | 1 | 1.5 | 1 | 1 | 1 | 1 | 1 | 1 | 1 | 1 | 1 | 1 | 1 |
| Fe oxide | 3 | 1.5 | 3 | 3 | 3 | 3 | 3 | 3 | 3 | 3 | 3 | 3 | 3 |
| Color Difference | 2 | 1 | 2 | 3 | 5 | 5 | 5 | 2 | 3 | 5 | 5 | 5 | 5 |

What is claimed is:

1. A composition for marking by irradiation with a carbon dioxide or YAG laser beam, said composition comprising 100 parts by weight of a thermosetting resin, a colorant capable of discoloring upon being heated at a temperature of 250° C. or more, and at least 10 parts by weight of a particulate, laser beam absorbing substance which has an average particle size of 50 μm or less and which is at least one member selected from cordierite and zeolite; and wherein said colorant comprises a first, white substance which is converted into a second, white substance different from said first substance upon being heated at a temperature of 250° C. or more, said composition further comprising an auxiliary colorant which is inert to laser beam irradiation and which has a color other than white.

2. A composition according to claim 1, wherein said first substance is a compound selected from the group consisting of hydrated alumina, zinc carbonate and zinc borate and said auxiliary colorant is ferric oxide or titanium oxide.

3. A composition according to claim 1, wherein said colorant additionally includes a third substance which shows a color other than white at room temperature and which becomes colorless upon being heated at a temperature of 250° C. or more.

4. A composition according to claim 3, wherein said first substance is a compound selected from the group consisting of hydrated alumina, zinc carbonate and zinc borate and said third substance is an organic colorant or carbon black.

5. A composition for marking by irradiation with a carbon dioxide or YAG laser beam, said composition comprising 100 parts by weight of a thermosetting resin, a colorant capable of discoloring upon being heated at a temperature of 250° C. or more, and at least 10 parts by weight of a particulate, laser beam absorbing substance which has an average particle size of 50 μm or less and which is at least one member selected from cordierite and zeolite; and wherein said colorant comprises:

a first, white substance which is converted into a second, white substance different from said first substance upon being heated at a temperature of 250° C. or more, and a third substance which shows a color other than white at room temperature and which becomes colorless upon being heated at a temperature of 250° C. or more.

6. A composition according to claim 5, wherein said first substance is a compound selected from the group consisting of hydrated alumina, zinc carbonate and zinc borate and said third substance is an organic colorant or carbon black.

7. A composition for marking by irradiation with a carbon dioxide or YAG laser beam, said composition comprising 100 parts by weight of a thermosetting resin, a colorant capable of discoloring upon being heated at a temperature of 250° C. or more, and at least 10 parts by weight of particulate cordierite as a laser beam absorbing substance, said particulate cordierite having an average particle size of 50 μm or less; and wherein:

said colorant comprises a first substance showing a first color at room temperature and convertible to a second substance having a second color different from said first color upon being heated at a temperature of 250° C. or more.

8. A composition according to claim 7, further comprising an auxiliary colorant which is inert to laser beam irradiation and which has a color different from at least one of said first and second colors.

9. A composition according to claim 7, wherein said colorant additionally includes a third substance which shows a third color and which becomes colorless upon being heated at a temperature of 250° C. or more.

10. A composition according to claim 8, wherein said colorant additionally includes a third substance which shows a third color and which becomes colorless upon being heated at a temperature of 250° C. or more.

11. A marking method comprising the steps of forming a shaped body of a composition according to claim 1, hardening said shaped body to form a hardened body having a first color, and irradiating a surface of said hardened body with a laser beam to discolor said colorant, so that the irradiated surface has a second color different from said first color.

12. A marking method comprising the steps of forming a shaped body of a composition according to claim 5, hardening said shaped body to form a hardened body having a first color, and irradiating a surface of said hardened body with a laser beam to discolor said colorant, so that the irradiated surface has a second color different from said first color.

13. A marking method comprising the steps of forming a shaped body of a composition according to claim 7, hardening said shaped body to form a hardened body having a first color, and irradiating a surface of said hardened body with a laser beam to discolor said colorant, so that the irradiated surface has a second color different from said first color.

14. A composition for marking by irradiation with a carbon dioxide or YAG laser beam, said composition comprising 100 parts by weight of a thermosetting resin, a colorant capable of discoloring upon being heated at a temperature of 250° C. or more, and at least 10 parts by weight of particulate cordierite for laser beam absorption, said particulate cordierite having an average particle size of 50 μm or less, wherein said colorant is at least one member selected from the group consisting of copper oxalate, cobalt oxalate, aluminum acetylacetone, bismuth oxalate, silver acetate, metal titanates, basic nickel carbonate, basic copper carbonate, bismuth oxide, ferric hydroxide, ammonium vanadate, hydrated alumina, zinc borate, zinc carbonate, lead oxide, basic lead phosphite, basic lead sulfite, basic lead phosphite sulfite, lead phosphite, lead sulfite and organic dyes.

15. A composition according to claim 14, further comprising an auxiliary colorant whose color does not change upon being heated at a temperature of 250° C. or more.

16. A composition according to claim 15, wherein said auxiliary colorant is ferric oxide or titanium oxide.

17. A composition according to claim 14, further comprising an inorganic filler having an average particle size of 50 μm or less and selected from the group consisting of alumina, silica, magnesia, antimony trioxide, calcium carbonate, magnesium carbonate, mica, clay and sepiolite.

18. A composition according to claim 1, wherein said thermosetting resin is an epoxy resin and wherein said laser beam absorbing substance is dry zeolite having a water content of below 1% by weight.

19. A composition according to claim 14, wherein said colorant includes a first, white substance which is converted into a second, white substance different from said first substance upon being heated at a temperature of 250° C. or more, said composition further comprising an auxiliary colorant which is inert to laser beam irradiation and which has a color other than white.

20. A composition according to claim 19, wherein said first substance is a compound selected from the group consisting of hydrated alumina, zinc carbonate and zinc borate and said auxiliary colorant is ferric oxide or titanium oxide.

21. A composition according to claim 19, wherein said colorant additionally includes a third substance which shows a color other than white at room temperature and which becomes colorless upon being heated at a temperature of 250° C. or more.

22. A composition according to claim 21, wherein said first substance is a compound selected from the group consisting of hydrated alumina, zinc carbonate and zinc borate and said third substance is an organic colorant or carbon black.

23. A composition according to claim 14, wherein said colorant includes a first, white substance which is converted into a second, white substance different from said first substance upon being heated at a temperature of 250° C. or more, and a third substance which shows a color other than white at room temperature and which becomes colorless upon being heated at a temperature of 250° C. or more.

24. A composition according to claim 23, wherein said first substance is a compound selected from the group consisting of hydrated alumina, zinc carbonate and zinc borate and said third substance is an organic colorant or carbon black.

25. A composition according to claim 14, wherein said colorant includes a first substance showing a first color at room temperature and convertible to a second substance having a second color different from said first color upon being heated at a temperature of 250° C. or more.

26. A composition according to claim 25, further comprising an auxiliary colorant which is inert to laser beam irradiation and which has a color different from at least one of said first and second colors.

27. A composition according to claim 25, wherein said colorant additionally includes a third substance which shows a third color and which becomes colorless upon being heated at a temperature of 250° C. or more.

28. A composition according to claim 26, wherein said colorant additionally includes a third substance which shows a third color and which becomes colorless upon being heated at a temperature of 250° C. or more.

29. A marking method comprising the steps of forming a shaped body of a composition according to claim 14, hardening said shaped body to form a hardened body having a first color, and irradiating a surface of said hardened body with a laser beam to discolor said colorant, so that the irradiated surface has a second color different from said first color.

* * * * *

UNITED STATES PATENT AND TRADEMARK OFFICE

CERTIFICATE OF CORRECTION

PATENT NO. : 5,445,923 Page 1 of 2

DATED : August 29, 1995

INVENTOR(S) : TAKAHASHI et al

It is certified that error appears in the above-indentified patent and that said Letters Patent is hereby corrected as shown below:

Col. 7, line 20, after "shown in" insert --Tables 9-13. The background colors and the colors of the--;

between Table 2 and Table 3, delete "Tables 9-13. The background colors and the colors of the".

Cols. 9 and 10, Table 3-continued, line 16 of Table 3 - continued, "Cyanin Blue", under heading 27, delete "10", under heading 28, delete "40", under heading 29, delete "80", under heading 30, delete "100", under heading 31, delete "2", under heading 32, delete "5", under heading 33, delete "20", under heading 34, delete "50", under heading 35, delete "20", under heading 36, delete "20" and under heading 37, delete "1"; and insert --1-- under heading 39.

Cols. 11 and 12, Table 7, delete the first heading "82" and insert the heading --81--.

UNITED STATES PATENT AND TRADEMARK OFFICE

CERTIFICATE OF CORRECTION

PATENT NO. : 5,445,923

DATED : August 29, 1995

INVENTOR(S) : TAKAHASHI et al

It is certified that error appears in the above-indentified patent and that said Letters Patent is hereby corrected as shown below:

Cols. 13 and 14, Table 10, line 10 of Table 10, "BDRA" should read --BDMA--.

Signed and Sealed this

Sixteenth Day of July, 1996

*Attest:*

Bruce Lehman

BRUCE LEHMAN

*Attesting Officer*

*Commissioner of Patents and Trademarks*